US008944744B2

(12) United States Patent
Kleeberger et al.

(10) Patent No.: US 8,944,744 B2
(45) Date of Patent: Feb. 3, 2015

(54) DAMPING OR PREVENTION OF VIBRATIONS IN INDUSTRIAL TRUCKS

(75) Inventors: Michael Kleeberger, München (DE); Michael Buhl, München (DE); Michael Schipplick, Wolfratshausen (DE); Willibald Günthner, Vaterstetten (DE); Boris Lohmann, Unterschleisshelm (DE); Rudy Eid, München (DE)

(73) Assignee: Technische Universität München, Munich (DE)

( * ) Notice: Subject to any disclaimer, the term of this patent is extended or adjusted under 35 U.S.C. 154(b) by 722 days.

(21) Appl. No.: 13/052,573

(22) Filed: Mar. 21, 2011

(65) Prior Publication Data

US 2011/0243699 A1 Oct. 6, 2011

(30) Foreign Application Priority Data

Mar. 22, 2010 (DE) ..... 10 2010 016 062

(51) Int. Cl.

| | |
|---|---|
| ***B66F 9/075*** | (2006.01) |
| ***B66F 9/12*** | (2006.01) |
| ***B66F 9/08*** | (2006.01) |
| ***B66F 9/14*** | (2006.01) |

(52) U.S. Cl.

CPC ..... *B66F 9/125* (2013.01); *B66F 9/07545* (2013.01); *B66F 9/08* (2013.01); *B66F 9/148* (2013.01)

USPC ..... 414/664; 187/222; 414/629; 414/672

(58) Field of Classification Search

CPC ..... B66F 9/075

USPC ..... 414/629, 641, 642, 662, 663, 664, 672

See application file for complete search history.

(56) References Cited

U.S. PATENT DOCUMENTS

| | | | | |
|---|---|---|---|---|
| 3,225,949 | A * | 12/1965 | Erickson et al. | 414/629 |
| 3,574,383 | A * | 4/1971 | Frater | 294/67.2 |
| 3,757,899 | A * | 9/1973 | Smith, Jr. | 187/224 |
| 3,972,434 | A * | 8/1976 | Mecklenburg et al. | 414/664 |

(Continued)

FOREIGN PATENT DOCUMENTS

| | | |
|---|---|---|
| CH | 513056 | 9/1971 |
| DE | 2451070 | 4/1976 |

(Continued)

OTHER PUBLICATIONS

Flurforderzeugen et al., Know-how for Intralogistics, May 2008, 1 page (partial translation).

(Continued)

*Primary Examiner* — James Keenan

(74) *Attorney, Agent, or Firm* — RatnerPrestia

(57) ABSTRACT

An industrial truck is shown with a lifting frame, on which a load-receiving section is arranged so as to be movable vertically. The load-receiving section has at least one degree of movement freedom with respect to the lifting frame, which lies in a plane perpendicular to the main direction of travel of the industrial truck and has at least one horizontal component. In addition, a vibration control system is provided for damping or preventing vibrations in the relative position of load-receiving section and lifting frame.

19 Claims, 7 Drawing Sheets

(56) References Cited

U.S. PATENT DOCUMENTS

| | | | | | |
|---|---|---|---|---|---|
| 4,095,714 | A | | 6/1978 | Schuster | |
| 4,413,708 | A | * | 11/1983 | Stedman | 187/222 |
| 4,509,127 | A | * | 4/1985 | Yuki et al. | 700/218 |
| 4,540,330 | A | * | 9/1985 | Taylor | 414/641 |
| 5,022,496 | A | | 6/1991 | Klopfleisch | |
| 5,143,180 | A | * | 9/1992 | Harper | 414/629 |
| 5,579,859 | A | * | 12/1996 | Quellhorst et al. | 180/89.13 |
| 5,641,041 | A | * | 6/1997 | Masuda et al. | 187/347 |
| 5,657,834 | A | * | 8/1997 | Plaugher et al. | 187/226 |
| 5,984,050 | A | * | 11/1999 | Ronald | 187/226 |
| 6,467,582 | B1 | * | 10/2002 | Nakashima et al. | 187/244 |
| 6,672,467 | B2 | * | 1/2004 | Merkel et al. | 212/168 |
| 6,981,837 | B2 | * | 1/2006 | Gesser | 414/635 |

FOREIGN PATENT DOCUMENTS

| | | | |
|---|---|---|---|
| DE | 2508696 | | 9/1976 |
| DE | 3017147 | A1 | 11/1981 |
| DE | 3210951 | A1 | 10/1983 |
| DE | 3210951 | C2 | 10/1983 |
| DE | 10240851 | | 5/2003 |
| DE | 10240851 | A1 | 5/2003 |
| DE | 102007015488 | | 10/2008 |
| DE | 102007015488 | A1 | 10/2008 |
| DE | 102007024817 | | 10/2008 |
| DE | 102007024817 | A1 | 10/2008 |
| EP | 1975114 | | 10/2008 |
| GB | 1185997 | | 4/1970 |
| WO | 2006137761 | A1 | 12/2006 |

OTHER PUBLICATIONS

Latour et al., "Vibration absorption in wheeled loaders. Comparison of active and passive systems", Apr. 2003 (with translation).

Messerschmidt, "Dynamic Forces and Oscillations", Aug. 1992 (partial translation.

"4.2 Active Damping of Vehicle Vibrations", O&P Olhydraulik and Pneumatik 44 (2000), Nr. 7 (partial translation).

* cited by examiner

DAMPING OR PREVENTION OF VIBRATIONS IN INDUSTRIAL TRUCKS

FIELD OF THE INVENTION

The present invention relates to an industrial truck with a lifting frame, on which a load-receiving section is mounted so as to be movable vertically, and a method for damping or preventing vibrations in such industrial trucks.

BACKGROUND

In the prior art, industrial trucks are used for the placing into storage and removal from storage of loads in high rack warehouses. Examples of such industrial trucks are stacking vehicles such as forklift trucks and forklift reach trucks. A generic industrial truck comprises a lifting frame on which a load-receiving section is mounted so as to be movable vertically. The term "load-receiving section" is to be understood broadly in the present document and can comprise all components which are arranged so as to be movable vertically on the lifting frame. A load fork and a load fork carrier typically belong to the load-receiving section. In some generic industrial trucks, the load-receiving section further comprises a driver's station which is moved vertically on the lifting frame together with the load. Such industrial trucks are known under the term "man-up equipment" or vertical order picker.

It is a known problem that in generic industrial trucks, vibrations occur in the lifting frame. These vibrations are generally all the more pronounced, the further the load-receiving section is moved vertically, and the amplitude of the vibrations is greatest at the free end of the frame, i.e. in the region of the load-receiving section which has been moved upwards. As long as the load-receiving section oscillates to and fro due to the vibrations of the lifting frame, no loads can be received or deposited. Instead, the operator must wait with the stationary vehicle, until these vibrations have died down. Through these waiting times, however, the productivity of the vehicle is severely reduced. In man-up equipment, as a further problem it occurs that the oscillation movements of the driver's station, which has been moved upwards, are very unpleasant for the operator.

In DE 32 10 951 C2 the problems of lifting frame vibrations in the receiving and depositing of loads or respectively of load carriers, e.g. pallets, are described. According to the teaching of DE 32 10 951, reflex marks are applied to the shelf surfaces or to the pallets, said reflex marks being detected by a sensor fastened to the load fork, in order to determine the relative position of the shelf or pallet and load fork. By determining the relative position of shelf or pallet and load fork, the load fork can be aligned automatically for receiving or depositing the load. The actual function of the reflex mark and of the sensor consists in that the industrial truck can transport, receive and deposit loads automatically without a driver.

According to DE 32 10 951, however, with the aid of the reflex mark and the sensor in addition the phase and amplitude of the vibrations of the lifting frame can be measured in the direction of travel of the industrial truck. The load fork of the described industrial truck is adjustable relative to the lifting frame horizontally in the direction of travel and is provided with a corresponding drive means, in order to move the load fork forward and backward—in relation to the direction of travel of the industrial truck—on depositing or receiving loads. For the damping of the vibrations of the lifting frame in the plane of the direction of travel, DE 32 10 951 suggests actuating the drive means, which are present anyhow, between the load fork and the lifting frame so that the vibrations of the load fork are damped. For this, the drive means is regulated as a controlling element of a closed-loop control so that the sensor on the load fork is brought close to a desired zero position in relation to the reflex mark.

The described active vibration damping only takes place, however, on the receiving or respectively depositing of the load, because the entire controlling or respectively adjusting is oriented to the reflex mark on the shelf or on the pallet. The main purpose of DE 32 10 951 is therefore to shorten the waiting time of the stationary industrial truck in front of the shelf until the vibrations have died down sufficiently. However, this document does not give any suggestion of also already damping, during travel, vibrations, which typically are produced during travel.

A method which is similar in conceptual design for the damping of vibrations of the lifting frame of an industrial truck is known from applications DE 10 2007 015 488, DE 10 2007 024 817 A1 and EP 1 975 114 A1, which are related with regard to content and belong to the same patent family. In the industrial truck concerned, the lifting frame is able to be moved forward and back as a whole in the direction of travel. In order to damp vibrations of the lifting frame in the plane of the direction of travel, these applications suggest functionalizing the drive, which is present anyhow, for the horizontal displacement of the lifting frame in the direction of travel as a controlling element in a regulator circuit, with which vibrations of the lifting frame are to be regulated to zero. Herein, a sensor, by which the amplitude of the vibration of the lifting frame can be measured, serves as measurement indicator for the regulator, this sensor being in actual terms a strain gauge or an acceleration sensor on the lifting frame.

The prior art from the said patent family is similar to the above-mentioned DE 32 10 951 C2 in so far as a drive means, which is present in any case and is required for operating the industrial truck, is additionally used by suitable controlling or regulating in order to damp vibrations of the lifting frame. Differently from the DE 32 10 951 C2, however, according to the teaching of this patent family, vibrations can also be damped during travel.

Despite the steps for the damping of vibrations from the prior art described above, the problem of vibrations in industrial trucks can not be regarded as being solved. Especially with the higher travelling and working speeds which are aimed for in the course of increasing productivity, the vibrations on the lifting frame in practice often constitute a limiting factor.

The invention is therefore based on the problem of providing an industrial truck and a method in which vibrations in the lifting frame can be efficiently damped or even prevented entirely.

SUMMARY

This problem is solved by an industrial truck, as is described herein.

In the industrial truck according to the invention, the load-receiving section has at least one degree of movement freedom in relation to the lifting frame, which lies in a plane perpendicular to the main direction of travel and has at least one horizontal component. In addition, means are provided for damping or preventing vibrations in the relative position of the load-receiving section and lifting frame along this degree of freedom.

According to the invention, therefore an additional degree of movement freedom is created between the load-receiving section and the lifting frame. This degree of movement freedom is an additional degree of freedom which is not provided for the intended operation of the industrial truck and serves for a decoupling of the load-receiving section and lifting frame. Instead of the load-receiving section and the lifting frame carrying out a common vibration movement as in the prior art, which would lead to considerable vibration amplitudes in the region of the load-receiving section, this additional degree of freedom allows for the load-receiving section and the lifting frame to vibrate against each other. These vibrations in the relative position of the load-receiving section and lifting frame, which could not occur at all without this additional degree of freedom, are then dissipated by said means for damping or preventing vibrations. In other words, the vibrational energy of the total system of lifting frame and load-receiving section, which is unavoidably produced during operation, is transferred into the newly created degree of freedom and can be dissipated in this degree of freedom by the damping means, so that the vibration energy can be efficiently removed from the total system.

The additional degree of freedom is perpendicular to the main direction of travel of the vehicle and has at least one horizontal component, whereby vibrations can be efficiently damped transversely to the direction of travel. In practice, vibrations transversely to the direction of travel constitute a particular problem. Transverse vibrations can be produced for example when the industrial truck travels over an unevenness in the ground. As the typical sources of vibrations in the direction of travel, namely braking and accelerating operations, are carried out in a planned manner, these manoeuvres can already be carried out so that only few vibrations occur at all in the direction of travel. This predictability does not exist in the main source of transverse vibrations, namely unevennesses in the ground. Therefore, transverse vibrations can occur in a surprising manner at any time and also can scarcely be avoided by careful operation.

Transverse vibrations therefore constitute a particular problem, because they harbour the risk that the lifting frame strikes laterally against the shelves. In order to save storage space, small aisle widths are selected between the shelves, which exceed the vehicle width only by a safety distance of 100 mm on both sides. With such small distances between the shelves and the vehicle, collisions with the lifting frame can easily occur through transverse vibrations.

Compared with the prior art which was discussed in the introduction, the invention therefore has the following conceptual differences:

(i) An additional degree of freedom is created, which serves for the decoupling of the lifting frame and load-receiving section. In the prior art discussed above, always a drive which was present anyhow and was necessary for the operation was controlled or regulated additionally for the improved damping.

(ii) Vibrations in the newly created degree of freedom, i.e. the relative movements between load-receiving section and lifting frame, which only become possible through the newly created degree of freedom, are damped. This is different conceptually from the quoted prior art. For example, in DE 32 10 951 the vibration of the load fork with respect to a reflex mark on the shelf or pallet is dissipated, but not a vibration between the load fork and the lifting frame. A similar fact applies for the patent family of DE 10 2007 015 488. Here, also, vibrations between the industrial truck and the lifting frame are not considered, but rather only vibrations within the lifting frame are determined by its deformation or acceleration and are then actively damped.

(iii) Finally, contrary to the quoted prior art, the invention allows energy to be dissipated from transverse vibration modes.

Said motion degree of freedom can be a horizontal translatory degree of freedom, a rotational degree of freedom, swing degree of freedom or a combination of two of these or all these. The "swing degree of freedom" designates here a degree of freedom which is produced when the load-receiving section is articulated on the lifting frame via two parallel pendulum rods and therefore corresponds to a displacement along a circular path, without the load-receiving section itself being rotated. More precise explanations concerning the different degrees of freedom are given below with reference to the example embodiments.

Preferably, the means for damping and preventing vibrations comprise active, semi-active and/or passive means, which are suitable for producing a force or a moment between the lifting frame and the load-receiving section, which has at least one component along said at least one degree of movement freedom.

Preferably a restoring element, in particular a spring, is provided which counteracts an elongation between the lifting frame and the load-receiving section along the degree of freedom. In addition, a damping element is preferably provided, which damps relative movements of the load-receiving section and the lifting frame.

Accordingly, in the simplest case, a simple, passive spring/damper combination can be provided between the lifting frame and the load-receiving section. The vibrations which would be produced in the case of a rigid connection of lifting frame and load-receiving section are converted into a damped relative vibration or oscillation between lifting frame and load-receiving section, so that the vibrational energy in this additional degree of freedom is dissipated effectively and quickly by the damping element.

In an advantageous further development, the restoring force or the restoring moment of the restoring element and/or the damping characteristic of the damping element can be adapted to one or more operating parameters, in particular to one or more of the following operating parameters: speed of travel, lift height, loading status, deformation status of the lifting frame and/or acceleration status of the lifting frame or of the load-receiving section. Whilst the restoring element and the damping element per se are passive elements, because they do not have any drive means, their characteristics can be adapted as a function of the described operating parameters, in order to optimize the damping effect. The parameters of bending or deformation status or acceleration status are dynamic parameters, to which the restoring- and/or damping element can be adapted in real time, in order to effectively damp or entirely prevent vibrations. Passive elements which are able to be adapted to operating states in such a way are designated in the present document as "semi-active" elements. Semi-active elements in the sense of the present disclosure are elements which are able to be controlled electronically, but do not have their own drive means.

In an advantageous further development, at least one actuator is provided, which is suited to produce a force or moment between the lifting frame and the load-receiving section, which has at least one component along said at least one degree of movement freedom, and a control device and/or regulating device is provided for controlling or regulating the actuator such that vibrations in the relative position of load-receiving section and lifting frame are damped. The actuator can be an electromechanical, a pneumatic or a hydraulic controlling element. By the use of one or more controlled or regulated actuators, the damping effect can be further increased compared with a construction which is based only on passive or semi-active damping and restoring elements. In particular, such an actuator can be provided as a supplement to the passive or semi-active restoring or damping means.

Preferably, the controlling or regulating device is connected with at least one sensor for detecting the relative position of the lifting frame and load-receiving section. Preferably, the set value of the regulating device corresponds to a predetermined relative position of the lifting frame and load-receiving section. When the relative deviation or elongation along said degree of freedom is regulated to this set value, this means that the relative vibrations are damped out. In other words, this type of regulation is suitable for removing or dissipating vibration energy from the additional degree of freedom.

If the degree of freedom comprises a rotatory component, the set value or a further set value of the regulating device can correspond to a horizontal position of the load-receiving section. Thereby, it becomes possible to keep the load-receiving section in a horizontal state, even when the industrial truck travels over sloping ground.

Preferably, the controlling or regulating device is coupled with at least one sensor for detecting the deformation status of the lifting frame, for example a strain gauge or a piezoelectric sensor. Additionally or alternatively, the controlling or regulating device is preferably coupled with at least one acceleration sensor which is arranged on the lifting frame and/or on the load-receiving section. Preferably, the controlling or regulating device is further arranged to calculate the actuating variable for the actuator, taking into consideration one or more of the following operating parameters: speed of travel, lift height, loading status, bending or deformation status of the lifting frame and/or acceleration status of the lifting frame or of the load-receiving section.

The operating parameters of speed of travel, lift height and loading status change slowly in relation to the time scale of the regulating process. For each of these statuses, optimized regulator models can be developed and kept in readiness and then processed in the regulator according to the operating status.

In a particularly advantageous embodiment, several position- or acceleration sensors are arranged on the load-receiving section and the controlling or regulating device is adapted to calculate one or several control values as a function of the measured values of the position or acceleration sensors so that the load-receiving section carries out a pure translation movement. The aim of such a regulation is a status in which the load-receiving section is moved independently of the movement of the chassis of the industrial truck and of the lifting frame, as if it travelled along an imaginary ceiling rail. This type of damping is also designated as "skyhook" damping. Such a skyhook damping is only conceivable, however, because according to the invention one or several additional degrees of movement freedom are created between the load-receiving section and the lifting frame.

Preferably, said at least one degree of freedom is able to be locked, so that a relative movement is prevented between the lifting frame and the load-receiving section in the locked state. Such a locking is advantageous for example in the load transfer processes at the target position, in order to ensure that no relative movement is produced by the receiving or depositing of the load.

Preferably, a vertically movable auxiliary carrier is provided on the lifting frame, on which the load-receiving section is fastened movably in the direction of said at least one degree of freedom.

DETAILED DESCRIPTION

Further advantages and features of the industrial truck according to the invention and the method for damping or preventing vibrations in industrial trucks become apparent from the following description, in which the invention is explained in further detail with the aid of several example embodiments with reference to the attached drawings, in which FIG. 1 shows a perspective illustration of an industrial truck according to a further development of the invention;

FIG. 2 shows an exploded illustration of an industrial truck according to a further development of the invention with an degree of oscillation freedom;

FIGS. 3*a* and 3*b* show two schematic illustrations of the auxiliary carrier of FIG. 2;

Figure 7:
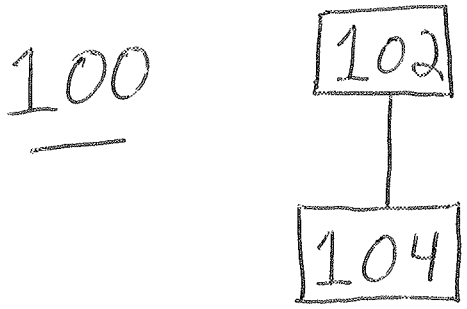

FIG. 7 depicts a method 100 for damping or preventing vibrations in an industrial truck having a lifting frame, on which a load-receiving section is arranged so as to be vertically displaceable, the method comprising: the step 102 of actively or semi-actively producing a force or a moment between the lifting frame and the load-receiving section; and the step 104 of controlling or regulating the force or movement so that vibrations are damped or prevented in the relative position of load-receiving section and lifting frame along a motion degree of freedom of the load-receiving section in relation to the lifting frame, wherein the motion degree of freedom lies in a plane perpendicular to the main direction of travel of the industrial truck and has at least one horizontal component.

Figure 1:
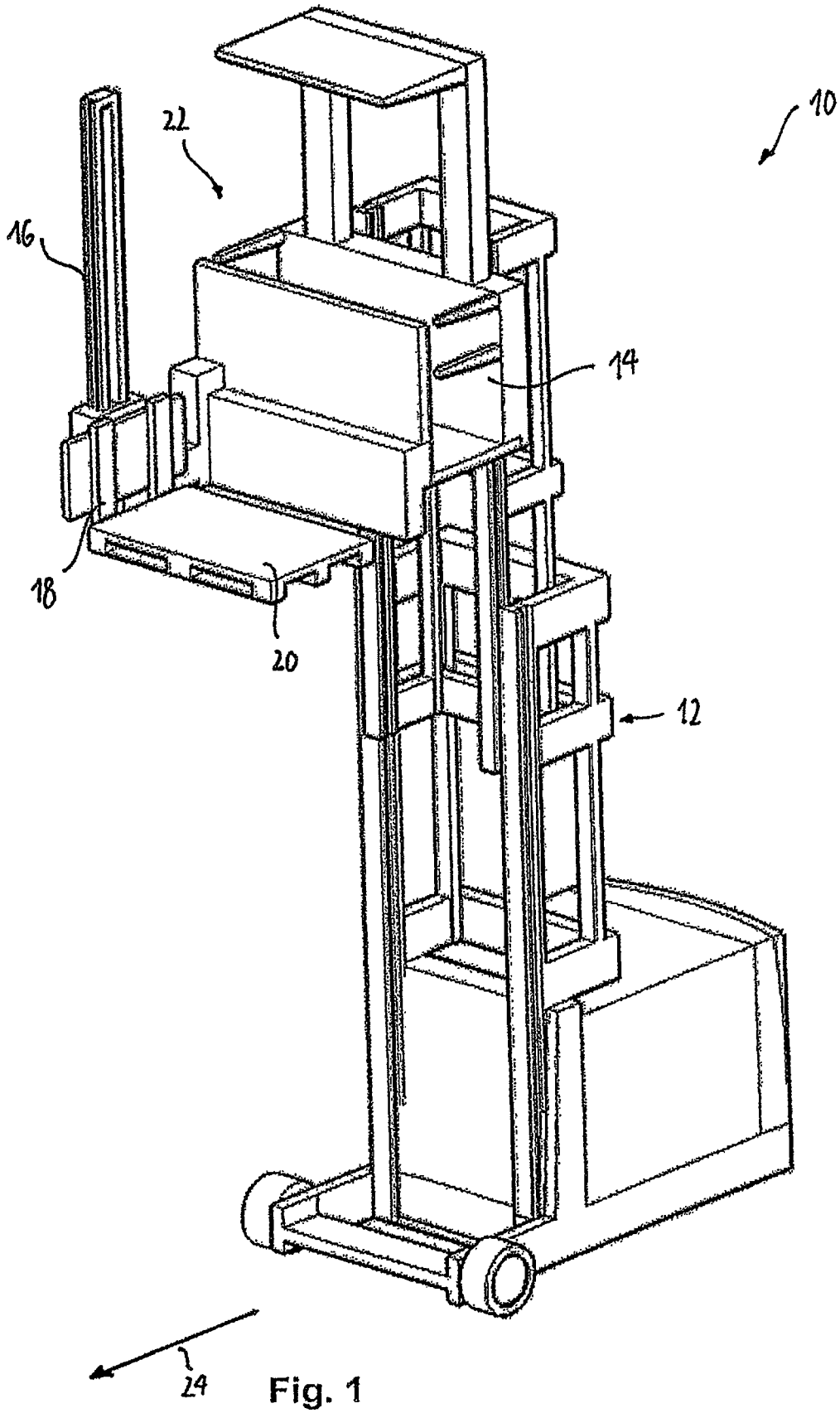

FIG. 1 shows a perspective view of an industrial truck 10 with a lifting frame 12 which is telescopically extendable, on which a driver's station 14, a load fork carrier 16 and a load fork 18 are fastened, which is partially covered in the figures by a pallet 20. Such an industrial truck with a liftable driver's station is also designated as "man-up equipment". The driver's station 14, the load fork carrier 16 and the load fork 18 in combination are referred to as "load-receiving section" 22 below. The main direction of travel of the industrial truck 10 is marked by the arrow 24.

Figure 2:
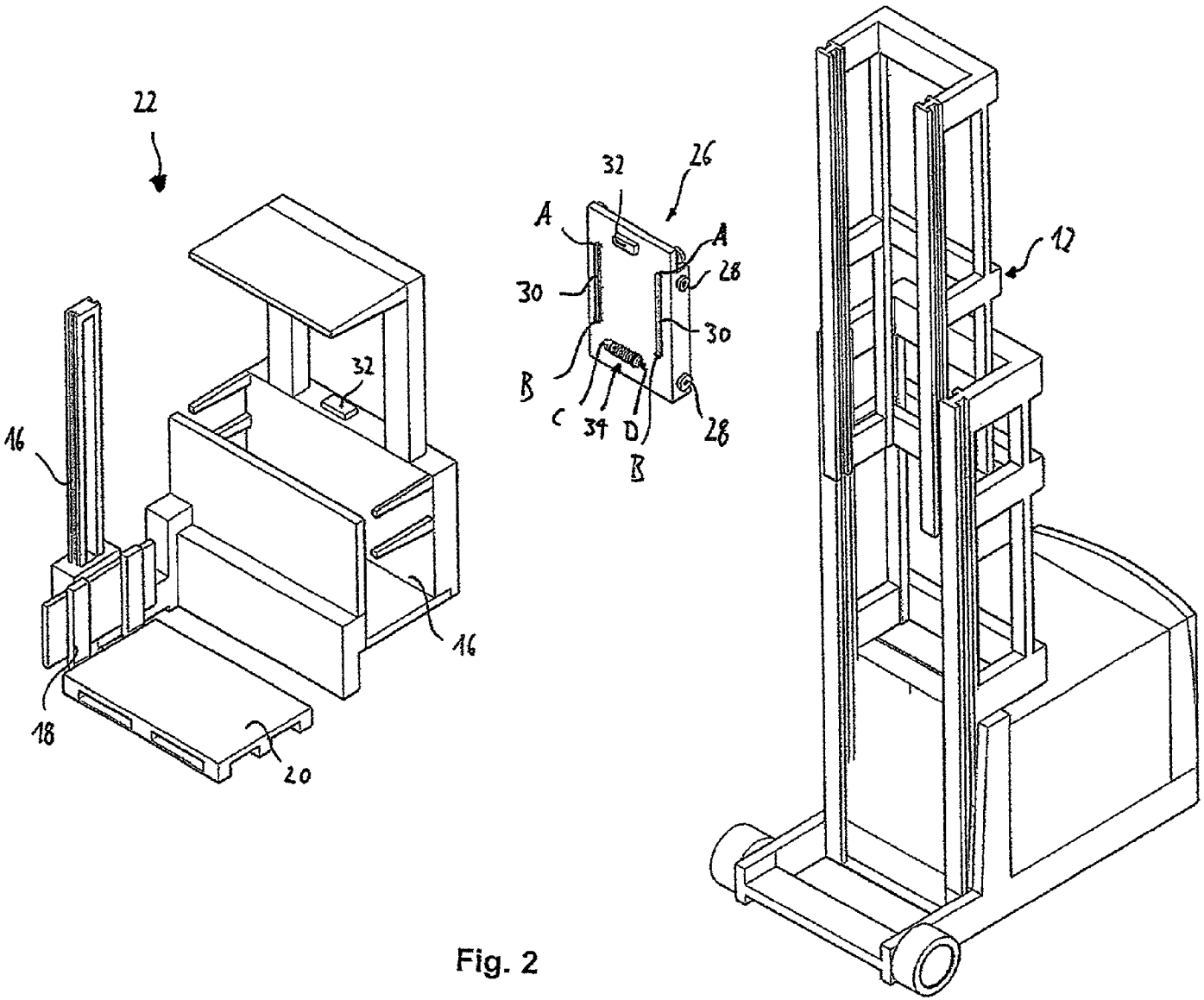

FIG. 2 shows an exploded illustration of the industrial truck of FIG. 1 according to a first embodiment of the invention. As can be seen in FIG. 2, according to this embodiment an auxiliary carrier 26 is provided which is mounted so as to be movable vertically over guide rollers 28 on the lifting frame 12.

On the auxiliary carrier 26, two rods 30 are articulated on pivot points A. Although this is not shown in the exploded illustration, the rods 30 are articulated with their respectively opposed ends on pivot points B on the driver's station 14, i.e. on the load-receiving section 22. Thereby, an additional degree of movement freedom is created in a plane transverse to the direction of travel, this being, in this example embodiment, a "swing degree of freedom". By the described suspension on the auxiliary carrier 26, the load-receiving section 22 can carry out a pendulum-like movement transverse to the direction of travel, in which the load-receiving section 22 is, however, always guided parallel to the lifting frame 12, which as a result corresponds to a displacement along a circular path. A position sensor 32 is provided on the auxiliary carrier 26 and on the load-receiving section 22, more precisely on the driver's station 14. The relative displacement or elongation between the auxiliary carrier 26 (or lifting frame 12) and the load-receiving section 22 then results from the comparison of the measured absolute position information.

In addition, a spring/damper combination 34 is fastened by a first end C on the auxiliary carrier 26 and by a second end at a point D on the load-receiving section 22, which can not be seen, however, in the exploded illustration of FIG. 2.

Figure 3B:
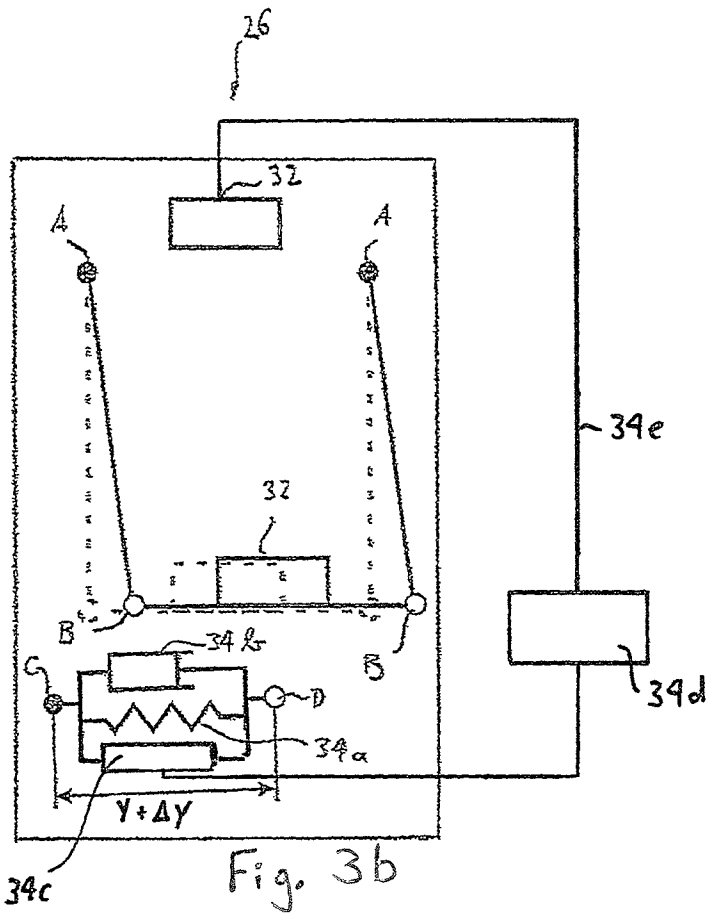
Figure 3A:
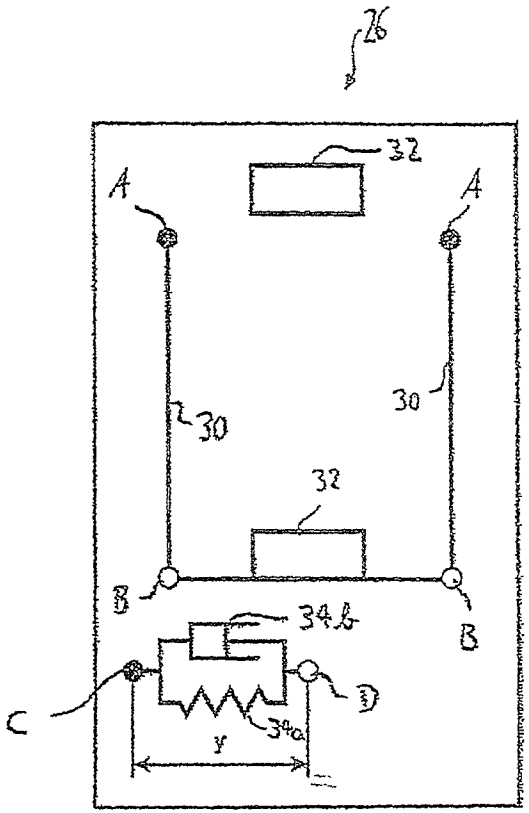

In FIG. 3*a* a schematic Illustration of the auxiliary carrier 26 of FIG. 2 is shown in the state of rest, and in FIG. 3*b* in the displaced or elongated state. In the schematic illustration of FIGS. 3*a* and 3*b*, the points A and C, which are fixed on the auxiliary carrier 26, are illustrated in black and the points B and D, which are fixed on the load-receiving section 22, are illustrated in white. In the schematic illustration, the spring/damper element 34 was illustrated functionally as a combination of spring element 34*a* and damper element 34*b* arranged in parallel. With reference to FIGS. 3*a* and 3*b*, the function of the auxiliary carrier 26 and of the additional degree of freedom created by this is described as follows:

During the travel of an industrial truck 10, vibrations of the lifting frame 12 often build up, which may lead to an oscillating movement of the load-receiving section 22. These oscillating movements are all the greater, the higher the load-receiving section 22 has been moved upwards on or by the lifting frame 12. These oscillating movements are felt to be unpleasant by the driver in the driver's station 14 and harbour the danger that the load-receiving section 22 for example collides with storage shelves. This danger exists in particular in the case of vibrations transversely to the direction of travel. These vibrations usually still last for a certain time after the industrial truck has been stopped for example for a load transfer. This means that between the stopping and the dying down of the vibrations, one must wait for the load transfer, so that this time elapses unproductively.

In the industrial truck 10 according to FIG. 2, the vibrations which in the case of a rigid connection between lifting frame 12 and load-receiving section 22 would have lead to the described oscillating movement, are—at least with respect to their component in transverse direction—transferred to the additional swing degree of freedom provided by the auxiliary carrier 26. Instead of a swing or pendular movement of the entire unit of lifting frame 12 and load-receiving section 22, now a relative vibration occurs along the additional degree of freedom between lifting frame 12 and load-receiving section 22. By the planned damping of the vibration by means of the additional degree of freedom, it is achieved that with the same stimulus, lower (absolute and relative) vibration amplitudes occur, which die down more quickly through the dissipative effect of the damper 34*b* than is the case in the current state of the art. In this way, intrusive vibrations are reliably damped or are already prevented from occurring.

With the position sensors 32, the relative deviation or elongation between lifting frame 12 and load-receiving section 22 can be determined along the pendular or swing degree of freedom. In the case of a purely passive damping device, as is formed by a simple spring/damper element 34, there is, however, no need yet for the absolute position information of the individual sections (auxiliary carrier 26 or load-receiving section 22) nor for the relative position information which can be derived therefrom. In a further development, the purely passive damping mechanism can, however, be supplemented or replaced by semi-active or active elements.

In a simple further development of the spring/damper combination 34, it is e.g. possible to adapt the restoring force of the spring 34*a* and/or the damping characteristic of the damping element 34*b* to one or more operating parameters. Suitable operating parameters for this are the speed of travel of the industrial truck 10, the lift height and the loading status of the load-receiving section 22. For each of these operating parameters, the ideal restoring force and damping characteristic can be determined in advance and then set upon operation.

Whereas these parameters do not change during a vibration cycle, it is also possible to modulate the restoring force and the damping characteristic on a faster time scale shorter than the vibration period. For example, the degree of damping of a damping element can be controlled very rapidly by electrical actuation of a bypass valve, so that it can be adapted optimally and in real time to an acceleration status of the lifting frame 12 or of the load-receiving section 22 in order to produce as effective a damping as possible. For this purpose, acceleration sensors can be provided (not shown) on the lifting frame 12 and/or on the load-receiving section 22.

In addition, it is possible to adapt the degree of damping of the damping element 34*b* as a function of the bending or deformation status of the lifting frame 12, which can be determined for example by means of strain gauges or piezoelectric sensors. The state of strain of the lifting frame is valuable information, because the movement resulting from the bending can already be forecast therefrom. It is therefore possible to actuate the damping element 34*b* as a function of these operating parameters or current system statuses in a manner which results in a more efficient damping of the vibration than is possible with purely passive elements. Such actuatable elements which do not have any drive means themselves are designated herein as semi-active elements.

In addition to or Instead of passive or semi-active means for damping or preventing vibrations in the relative position of lifting frame 12 and load-receiving section 22, at least one actuator (34*c*) can also be provided, which is suitable for generating a force between the lifting frame 12 and the load-receiving section 22 having at least one component along the swing degree of freedom of FIG. 2, and which is connected with a controlling device or a regulating device 34*d* via signal lines 34*e*. In order to control or regulate the actuator such that the vibrations in the relative position of load-receiving section 22 and lifting frame 12 are damped or prevented. The actuator 34*c* and the controlling or regulating device 34*d* are only depicted in FIG. 3*b* for simplicity. Herein, the relative position between the auxiliary carrier 26 and the load-receiving section 22 can be determined by means of the position sensors 32, and the deviation from a set value, which in this case corresponds to the non-deplaced status of FIG. 3*a*, can be introduced into the regulator. In order to make the regulation algorithm more efficient, in addition to the deviation or displacement from the position of rest, further values can be taken into consideration, in particular the operating parameters already mentioned above, i.e. speed of travel, lift height and loading status, or bending- or deformation status of the lifting frame 12 and acceleration status of the lifting frame 12 or of the load-receiving section 22. By the use of active control members and a suitable controlling or regulating device, the vibrations can therefore be damped particularly effectively in the additional swing degree of freedom.

The additional swing degree of freedom of FIG. 2 merely constitutes an example; a number of different degrees of freedom transverse to the direction of travel are likewise conceivable.

Figure 4:
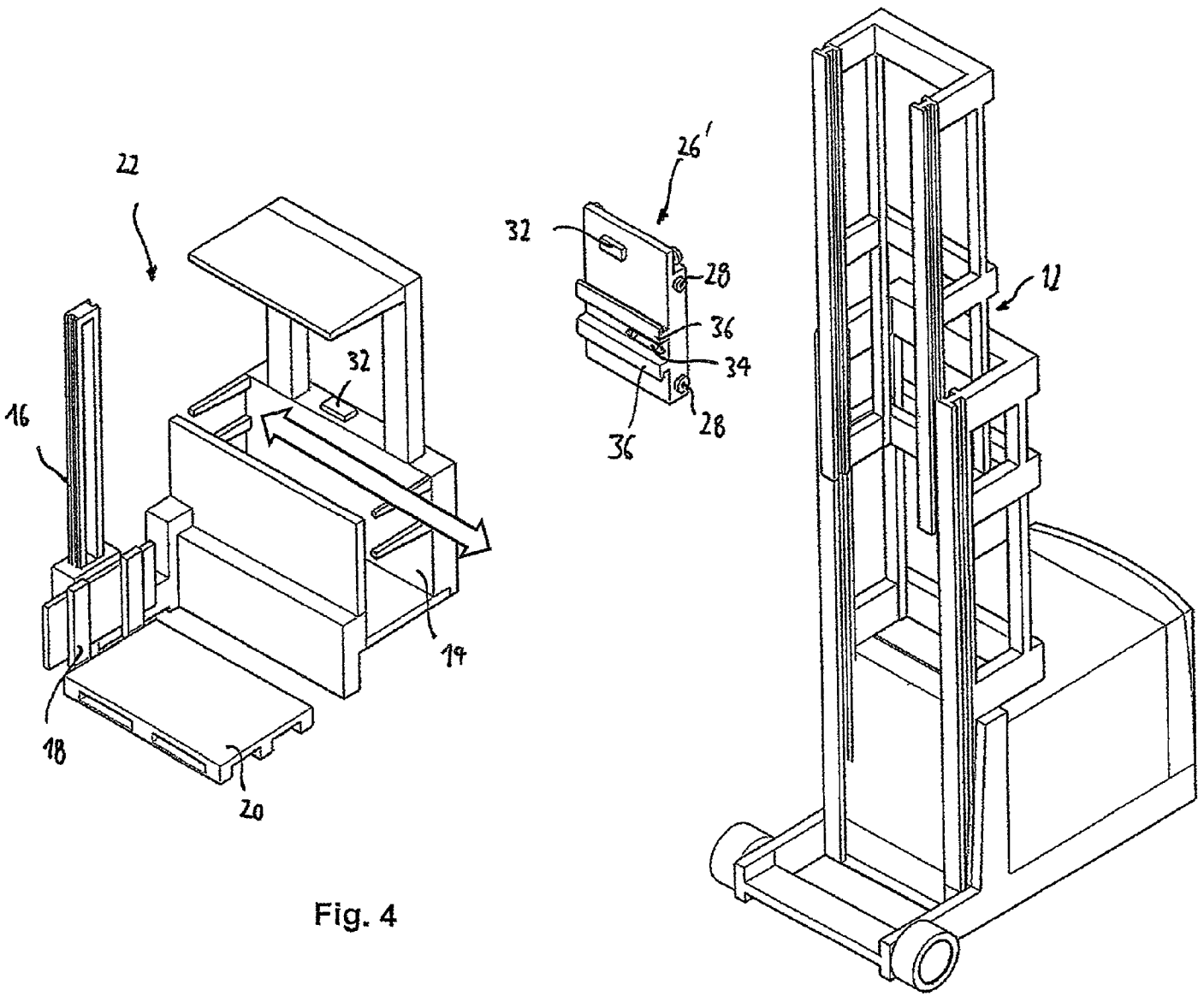
FIG. 4 shows an exploded drawing of an industrial truck with a horizontal translatory degree of freedom.

By way of example, FIG. 4 shows an embodiment in which the degree of freedom represents a horizontal translation transversely to the direction of travel. For this, horizontal running rails 36 are provided on the auxiliary carrier 26', on which the load-receiving section 22 is displaceably mounted (can not be seen in the exploded drawing of FIG. 4). In the illustration of FIG. 4 again a spring/damper combination 34 is illustrated, which acts in a similar manner to that of FIG. 2. Semi-active elements or controlled or regulated actuators can also be used for the damping of vibrations in this purely translatory degree of freedom in the same manner as described above.

Figure 5:
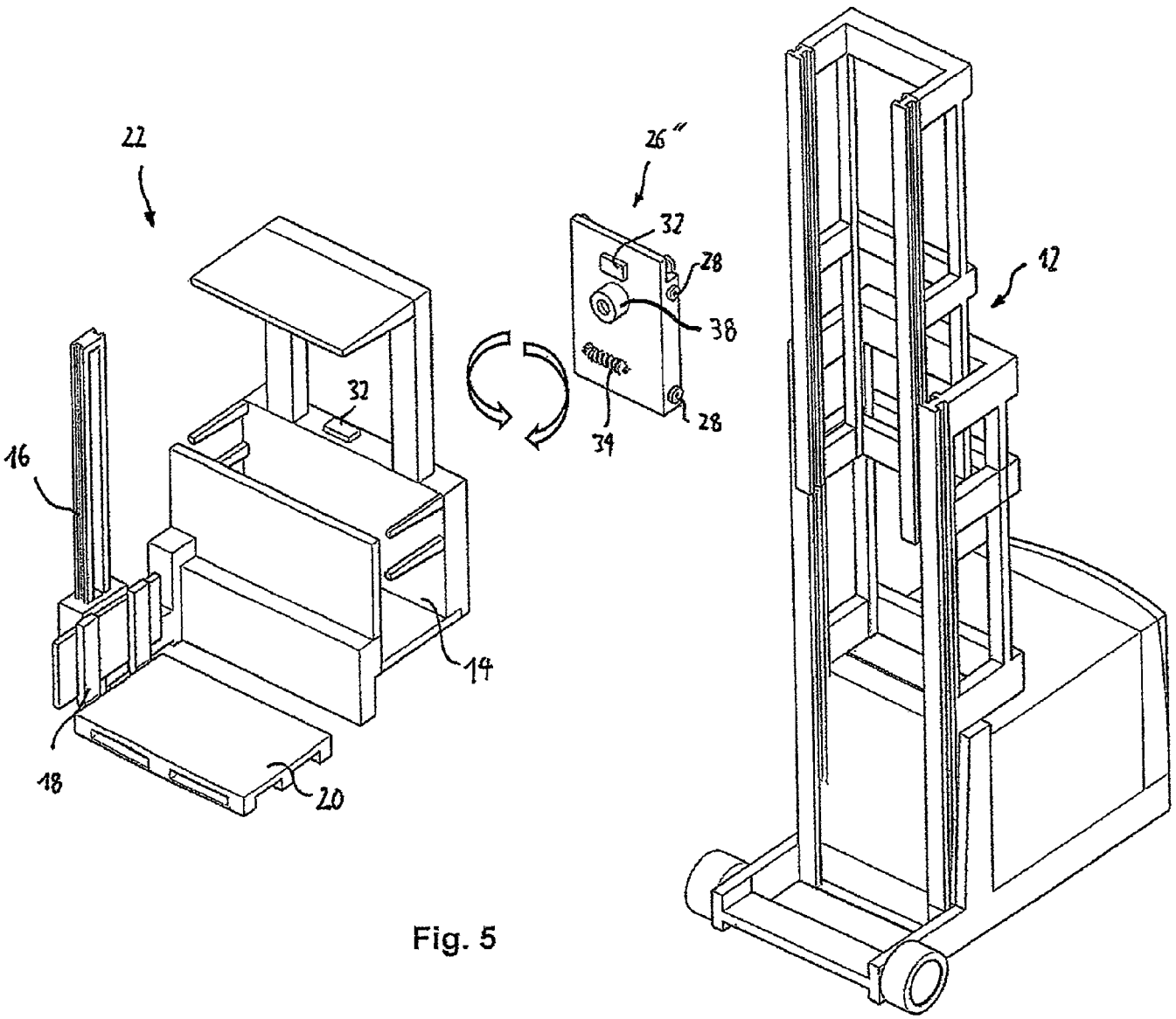
FIG. 5 shows an exploded drawing of an industrial truck with a degree of rotation freedom.

A further example is illustrated in FIG. 5. In the embodiment of FIG. 5, the auxiliary carrier 26" comprises a pivot bearing 38, on which the load-receiving section 22 is rotatably mounted (can not be seen in the exploded drawing of FIG. 5). This degree of rotation freedom is also located in a plane perpendicular to the main direction of travel of the industrial truck 10 and has a horizontal component. Therefore, this additional degree of freedom is also suitable for receiving transverse vibrations and to absorb them by suitable damping. For the absorption of the vibrations, a spring/damper element 34 is also shown in the embodiment of FIG. 5. However, it would be equally possible to provide a torsion spring and a controllable friction bearing.

Figure 6:
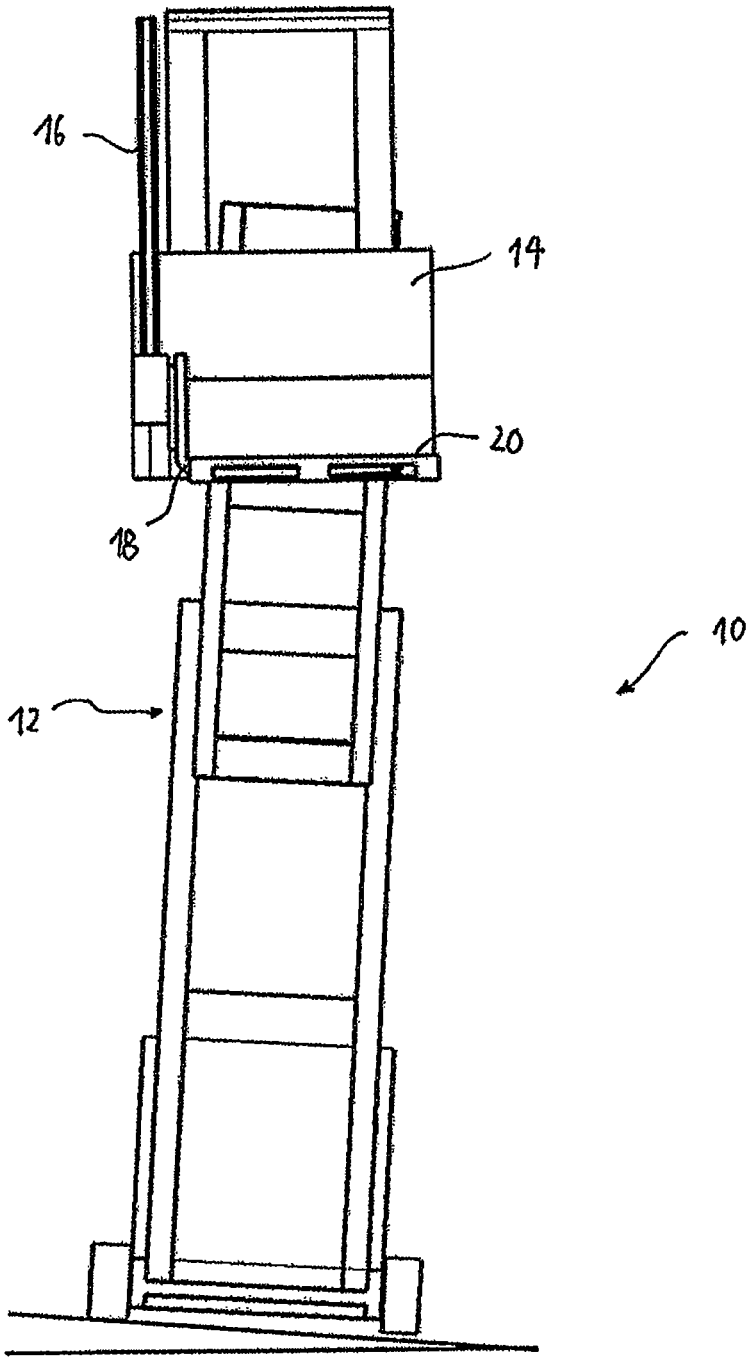
FIG. 6 shows a front view of an industrial truck, in which the load-receiving section is held horizontally on travelling over sloping ground.

In a particularly advantageous embodiment, two or all three of the described degrees of freedom could be combined with each other. An advantage of the rotational degree of freedom of FIG. 5 is that this degree of freedom allows for the load-receiving section 22 to be held horizontal even when the industrial truck 10 travels over sloping ground, as is schematically illustrated in FIG. 6. In this case, the actuators would be used not only in order to damp the vibrations between the lifting frame 12 and the load-receiving section 22, but also to produce a desired absolute position of the load-receiving section 22, namely a horizontal position. Deviations from this horizontal position can be detected by the position sensors 32 and can be introduced for example into a regulating device, the set value of which corresponding to a horizontal position.

By a combination of several degrees of freedom and the detecting of the absolute position or of the acceleration status of the load-receiving section 22 and a suitable actuation of the associated actuators, a so-called skyhook guidance can e.g. be provided, in which the load-receiving section 22—independently of the ground and the movement of the lifting frame—carries out a pure translation movement, as if it were guided on an imaginary rail.

In all the embodiments which are shown, expediently a locking mechanism (not shown) is provided, which locks the additional degree of freedom if required. This locking mechanism is used for example in load transfer, in which the industrial truck is standing and as rigid a connection as possible between the lifting frame 12 and the load-receiving section 22 is desirable.

Although preferred example embodiments are indicated and described in detail in the drawings and in the above description, this is to be regarded as purely by way of example and not restricting the invention. It is pointed out that only the preferred example embodiments are illustrated and described and all alterations and modifications which currently and in the future lie within the scope of protection of the invention are to be protected.

The invention claimed is:

1. Industrial truck having one or more intended operations for moving an object along one or more intended degrees of freedom, the industrial truck comprising: a lifting frame, on which a load-receiving section is arranged so as to be movable vertically during one of the intended operations, wherein the load-receiving section has at least one unintended motion degree of freedom in relation to the lifting frame for damping or preventing vibrations in the lifting frame in a direction transversely to a main direction of travel of said industrial truck, said unintended motion degree of freedom lying in a plane perpendicular to the main direction of travel of said industrial truck and having at least one horizontal component, and means for either damping or preventing vibrations in a relative position between the load-receiving section and the lifting frame along said at least one unintended motion degree of freedom, wherein said industrial truck is not configured to move said load-receiving section along said at least one unintended motion degree of freedom during any of the intended operations for moving an object along the one or more intended degrees of freedom.

2. Industrial truck according to claim 1, in which said unintended motion degree of freedom is a horizontal translatory degree of freedom, a rotational degree of freedom or a combination thereof.

3. Industrial truck according to claim 1, in which the means for either damping or preventing vibrations comprise at least one of active, semi-active or passive means suitable for generating a force or a moment between the lifting frame and the load-receiving section, having a component along said at least one unintended motion degree of freedom.

4. Industrial truck according to claim 1, in which a restoring element is provided, which counteracts a displacement of the lifting frame with respect to the load-receiving section along said at least one unintended motion degree of freedom.

5. Industrial truck according to claim 4, in which at least one of a restoring force of the restoring element or a damping characteristic of a damping element is configured to be adapted to one or more operating parameters, selected from a group consisting of: speed of travel, lift height, loading status, bending or deformation status of the lifting frame, and acceleration status of the lifting frame or of the load-receiving section.

6. Industrial truck according to claim 1, in which a damping element is provided, which damps relative movements between the load-receiving section and the lifting frame.

7. Industrial truck according to claim 1, in which at least one actuator is provided, which is suitable for generating a force between the lifting frame and the load-receiving section having at least one component along said at least one unintended motion degree of freedom, and with at least one of a control device or regulating device for controlling or regulating the actuator such that vibrations are damped in the relative position of the load-receiving section and of the lifting frame.

8. Industrial truck according to claim 7, in which the actuator is an electromechanical, a pneumatic or a hydraulic controlling element.

9. Industrial truck according to claim 7, in which the control or regulating device is connected with at least one sensor for detecting the relative position of the lifting frame and the load-receiving section.

10. Industrial truck according to claim 7, in which a set value of the control or regulating device corresponds to a predetermined relative position of the lifting frame and the load-receiving section.

11. Industrial truck according to claim 7, in which said at least one unintended motion degree of freedom comprises a rotatory component and a set value of the control or regulating device corresponds to a horizontal position of the load-receiving section.

12. Industrial truck according to claim 7, in which the control or regulating device is coupled to at least one sensor for detecting a bending or deformation status of the lifting frame.

13. Industrial truck according to claim 7, in which the control or regulating device is coupled with at least one acceleration sensor arranged on the lifting frame or on the load-receiving section.

14. Industrial truck according to claim 7, in which the control or regulating device is adapted to calculate an actuating variable for the actuator taking into consideration one or more of the following operating parameters: speed of travel, lift height, loading status, bending or deformation status of the lifting frame or acceleration status of the lifting frame or of the load-receiving section.

15. Industrial truck according to claim 7, in which several position or acceleration sensors are arranged on the load-receiving section and the control or regulating device is arranged to calculate one or several control values as a function of measured values of the position or acceleration sensors so that the load-receiving section carries out a purely translatory movement.

16. Industrial truck according to claim 1, in which a relative movement between the lifting frame and the load-receiving section is prevented along said at least one unintended motion degree of freedom.

17. Industrial truck according to claim 1, in which on the lifting frame a vertically movable auxiliary carrier is arranged, on which the load-receiving section is fastened movably in the direction of said at least one unintended motion degree of freedom.

18. Industrial truck according to claim 1, in which the load-receiving section comprises a driver's station.

19. A method for damping or preventing vibrations in an industrial truck having one or more intended operations for moving an object along one or more intended degrees of freedom, the industrial truck having a lifting frame, on which a load-receiving section is arranged so as to be vertically displaceable during one of the intended operations, the method comprising:

actively or semi-actively producing a force or a movement between the lifting frame and the load-receiving section; and controlling or regulating the force or movement so that vibrations are either damped or prevented in the relative position of the load-receiving section with respect to the lifting frame along an unintended motion degree of freedom of the load-receiving section in relation to the lifting frame for damping or preventing vibrations in the lifting frame in a direction transversely to a main direction of travel of said industrial truck, wherein the unintended motion degree of freedom lies in a plane perpendicular to the main direction of travel of the industrial truck and having at least one horizontal component, wherein said industrial truck is not configured to move said load-receiving section along said at least one unintended motion degree of freedom during any of the intended operations for moving an object along the one or more intended degrees of freedom.

* * * * *